United States Patent [19]

Ziegler et al.

[11] Patent Number: 4,493,234

[45] Date of Patent: Jan. 15, 1985

[54] DEVICE FOR STRAIGHTENING AND CUTTING A TEXTILE STRIP

[75] Inventors: Hans Ziegler, Grossbardorf; Siegfried Henze, Hohenroth; Rainer Dippert, Bad Königshofen; Martin Schnaus, Grosseibstadt; Horst Golda, Saal, all of Fed. Rep. of Germany

[73] Assignee: Texpa-Arbter Maschinenbaugesellschaft mbH, Fed. Rep. of Germany

[21] Appl. No.: 544,070

[22] Filed: Oct. 20, 1983

Related U.S. Application Data

[63] Continuation-in-part of Ser. No. 250,200, Apr. 2, 1981, abandoned.

[30] Foreign Application Priority Data

Apr. 3, 1980 [DE] Fed. Rep. of Germany ..... 3013050

[51] Int. Cl.[3] ..... B26D 5/42

[52] U.S. Cl. ..... 83/175; 83/251; 83/367; 83/925 CC; 26/51.4

[58] Field of Search ..... 26/51.3, 51.4, 51.5; 83/18, 175, 251, 367, 925 CC

[56] References Cited

U.S. PATENT DOCUMENTS

| | | | |
|---|---|---|---|
| 2,716,266 | 8/1955 | MacIsaac, Jr. et al. | 26/51.4 |
| 3,182,536 | 5/1965 | Sumpter, Jr. et al. | 26/51.3 X |
| 3,192,811 | 7/1965 | Simmons | 26/51.4 X |
| 4,034,634 | 7/1977 | Arbter | 26/51.3 X |
| 4,187,132 | 2/1980 | Dijk et al. | 26/51.4 X |

FOREIGN PATENT DOCUMENTS

| | | | |
|---|---|---|---|
| 2073271 | 10/1981 | United Kingdom | 26/51.4 |

*Primary Examiner*—Robert R. Mackey

*Attorney, Agent, or Firm*—Jacobi Siegel Presta Marzullo & Aronson

[57] ABSTRACT

A device for straightening a distorted strip article, particularly a textile strip having a marking thread or the like, and for cutting along a stitch or print line of the strip article. A plurality of movable straightening elements are arranged transverse to the length of the strip article and are movable into engagement with the strip and adjustable by a transport device in the longitudinal direction of the strip article. The straightening elements 18 are movable longitudinally and into engagement with the strip article independently of each other. A sensor device controls the movement of the straightening elements in response to control signals produced by the marking thread. The transport device is disposed transversely to the length of the strip article in the area of the marking thread.

6 Claims, 8 Drawing Figures

DEVICE FOR STRAIGHTENING AND CUTTING A TEXTILE STRIP

CROSS REFERENCE TO RELATED APPLICATION

This application is a continuation-in-part of application Ser. No. 250,200, filed on Apr. 2, 1981, now abandoned.

BACKGROUND OF THE INVENTION

The invention relates to a device for the straightening of an article in strip formation which is out of line, particularly a textile strip to be cut along the stitch and/or along the print, with a plurality of straightening elements which are arranged transverse to the length of the strip article and can be pressed against it, and which are adjustable by a transport device along the length of the strip.

A device of this type is already known, e.g., from the disclosure of U.S. Pat. No. 4,034,634 which is incorporated herein by reference. In this embodiment, the straightening elements consist of wedge-shaped shoes, which are biased and mounted on a bar running transverse over the strip article, by means of which they can be lowered together and pressed against the strip article. This principle of operation however presupposes strip articles or textile strips of different thicknesses, so that the shoe-like straightening elements in lowered position find catch points on the textile strip. With a brushed material without pile, the straightening means can be lowered together, and in this position, with the material in check, can be moved in their discharge direction. When there is a distortion, the straightening elements are laid one after the other against the adjacent transverse borders of the layer and thus cause a straightening of the strip in that area, in order to be able to make the separation cut straight along the stitch.

If however the strip article which is to be straightened has a constant thickness, the preceding straightening device cannot be used, since there are then no contact points for such shoe-like straightening elements. This is the case for example with blankets woven by the Jacquard principle, if these blankets must be cut, or also with so-called single blankets, in which the print or the pattern does not run at right angles to the web, since the article has been drawn out of line by the after-treatment. Similar considerations arise with materials from which dust rags, cleaning rags, bedsheets and so forth are to be cut. All of these materials, until this time, had to be cut manually, if an accurate separation edge was to be achieved.

SUMMARY OF THE INVENTION

Therefore, an object of the invention is to provide a structurally simple device for the straightening of a strip article which is out of line, if it has an essentially constant thickness, in order to facilitate a machine cutting along the stitch and/or along the print of the strip at predetermined points.

According to the invention, this is provided by using a device of the sort indicated in that the straightening elements are arranged independent from each other and longitudinally movable and can be pressed against the strip article independently and separately by control signals which are produced by a sensor device picking up a marking, e.g., a marking thread on the strip material, and in that the transport device for the alignment of the straightening elements in contact with the strip article is constructed transverse to the length of the article in the area of the marking. Dependent upon the distortion of the strip article, control signals are released at different time points throughout the marking through the sensor device, which control signals cause certain straightening elements to be pressed against the strip article, while these are being moved in the discharge direction. Thereby, the lowered straightening elements are carried by the strip article, so that no further distortions or stresses resulting therefrom can originate in the article.

When all of the straightening elements are brought into engagement with the strip article in this manner, their feed is disconnected and the transport device is set in function, in order to align the straightening elements in contact with the strip article, transverse to the length or direction of movement of the article in the area of the marking, or to set all lowered straightening elements in one straight line, which runs at a right angle to or transverse to the direction of movement of the strip article. Thereby, on the basis of the contact of the straightening elements with the strip article, the strip is also set straight, so that, insofar as desired, a separation cutting along the stitch and/or the print can be made immediately by means of a cutting device which can be connected to the straightening device in discharge direction of the article.

By means of the device according to the invention, articles in strips with constant thickness in the area of their markings could thereby be satisfactorily straightened or be brought back into their original positions, and it can remedy curved or ripple-like distortions or crease distortions and so forth, if desired.

The type of sensor device is dependent upon the marking used on the strip article. This can consist e.g. of a metallic thread, a colored marking line or colored marking points woven in. Accordingly, traditional electromagnetic or photoelectric sensor components could be provided.

It is advantageous, for example, that the sensor devices have several sensor elements, arranged transverse to the length of the strip article, at such spacing from each other that the sensor elements in the discharge direction of the article are at least somewhat aligned with the straightening elements. In this case, one straightening element can be connected with one sensor element and their numbers can be determined dependent upon the condition of the articles to be straightened and the degree of the distortions, in order in each case to guarantee straightening of the strip article on a stitch and/or pattern line, so that it can be separated exactly.

In one configuration of the invention, it is assured that the straightening elements pressed against the articles in strips can also be easily carried along by these, until all of the straightening elements are lowered and the article comes to a stop.

A further structural simplification of the device is attained wherein one and the same bar, plate or the like supports both the numerous sliding carriages with the straightening elements and also the transport device for said straightening elements. This also produces a compact structure.

According to another feature of the invention, the transport device used for the transverse alignment of the straightening elements in contact with the strip article is advantageously also used as transport device for the return and fixation of the sliding carriages in their original positions.

Further, the invention comprises a particularly simple detachable coupling between the transport device and the individual sliding carriages, which can serve for the return of the same into their original positions and their fixation in the original positions.

BRIEF DESCRIPTION OF THE DRAWINGS

The invention is explained relative to the drawings of an exemplary embodiment. They show.

DESCRIPTION OF THE PREFERRED EMBODIMENT

Figure 1:
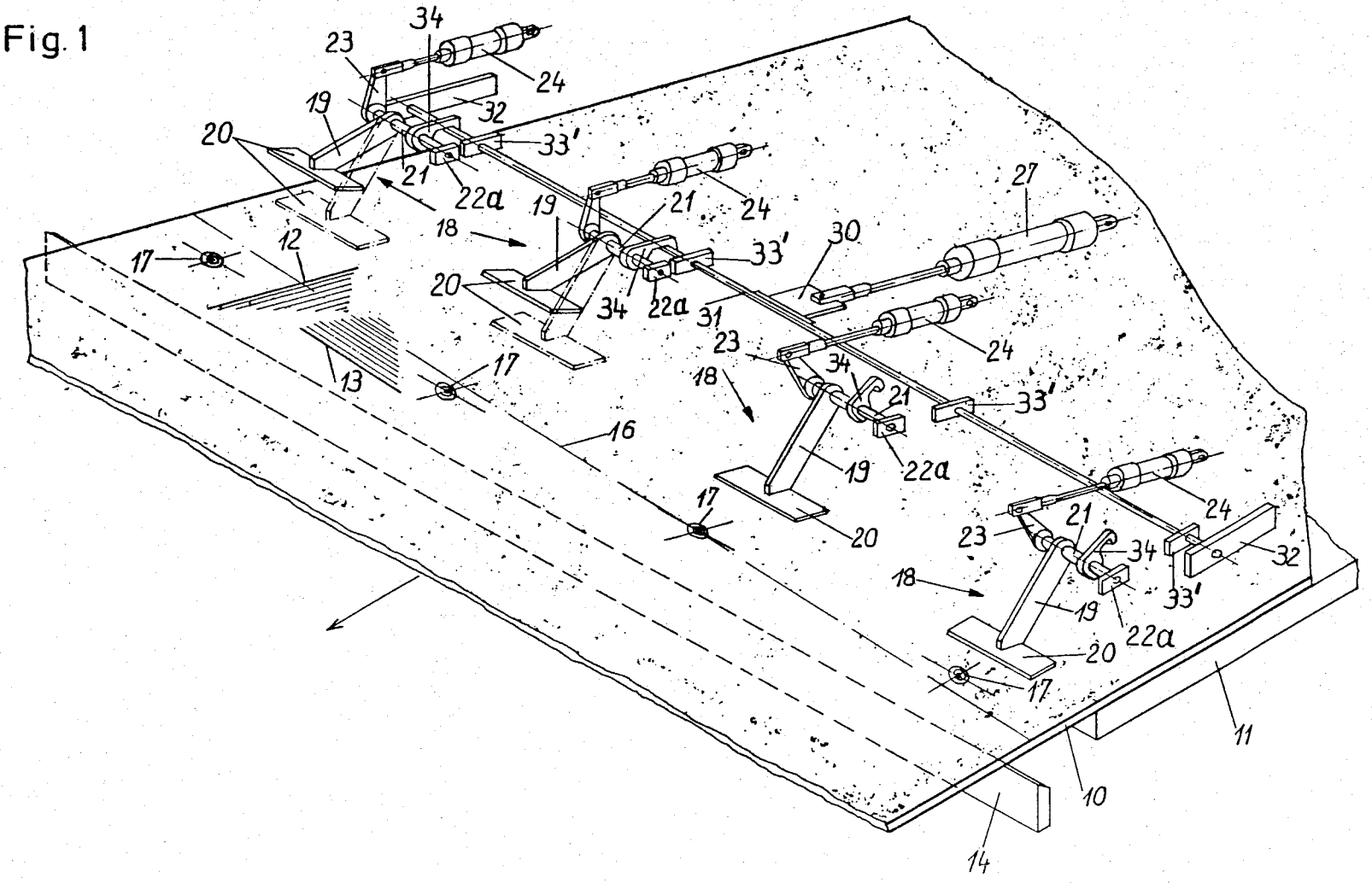
FIG. 1 is a perspective view of a part of a distorted or misaligned strip of textile material with the most important parts of the straightening device according to the invention at the beginning of a straightening process.

The strip of textile material 10 is unwound from a delivery spool 41 by a pulling device 40 and is moved in the direction of the arrow over a support plate 11. Thus, the warp threads 12 and weft threads 13 (FIG. 1) in textile strip 10 are so misaligned and distorted that weft threads 13 run skewed, for example, and not at a proper right angle to the outside edges of strip 10. This skewed course of weft threads 13 is indicated in FIG. 1. Separation of strip 10 transverse to the direction of movement in this state would have the result that numerous weft threads 13 would shear along the separation line, which is not at all desirable. In order to guarantee a straight separation of strip 10, therefore, weft threads 13 must be aligned parallel to a separating device 42 or to its stationary bottom blade 14 and movable top blade 15, so that weft threads 13 are also at a right angle to the outside edges of strip 10.

Strip 10 is of constant thickness. A marking thread 16, e.g. a metal thread, is woven into this, according to the exemplary embodiment, indicated by a broken line in FIG. 1, for the purpose of straightening strip 10. Thread 16 is parallel to weft threads 13. The marking thread 16, therefore, runs as in FIG. 1, skewed in the same manner as weft threads 13.

Delivery spool 41 can be rotated on two holder arms 43, which are mounted on a stand 44. Strip 10 extends from spool 41 upward over a guide roller 45 onto support plate 11, which is likewise mounted on stand 44. Guide roller 45 is supported in two arms 46 where it can rotate, which likewise are mounted on stand 44. Two brake plates 47 are mounted on a shaft 48 which is supported in arms 49, which are mounted on stand 44. When strip 10 is drawn by pulling device 40, these brake plates 47 exert friction on strip 10, so that the strip is held taut during the pulling process.

Separating device 42, as aforementioned, includes a stationary bottom blade 14 and a movable top blade 15. Top blade 15 is mounted on a blade support 52, which is supported with one end which can be rotated on an axis 53. Axis 53 is supported in two arms 54, which in turn are mounted on stand 44. In order to pivot blade support 52 around axis 53, and in order to move top blade 15 up and down to carry out a cut of textile strip 10, the blade support is connected with the piston 55 of a compressed air cylinder 56. Compressed air cylinder 56 is fastened with its one end on an arm 57, which is made fast in the middle to a transverse strut 58. Transverse strut 58 is supported by the supports 51.

Figure 7:
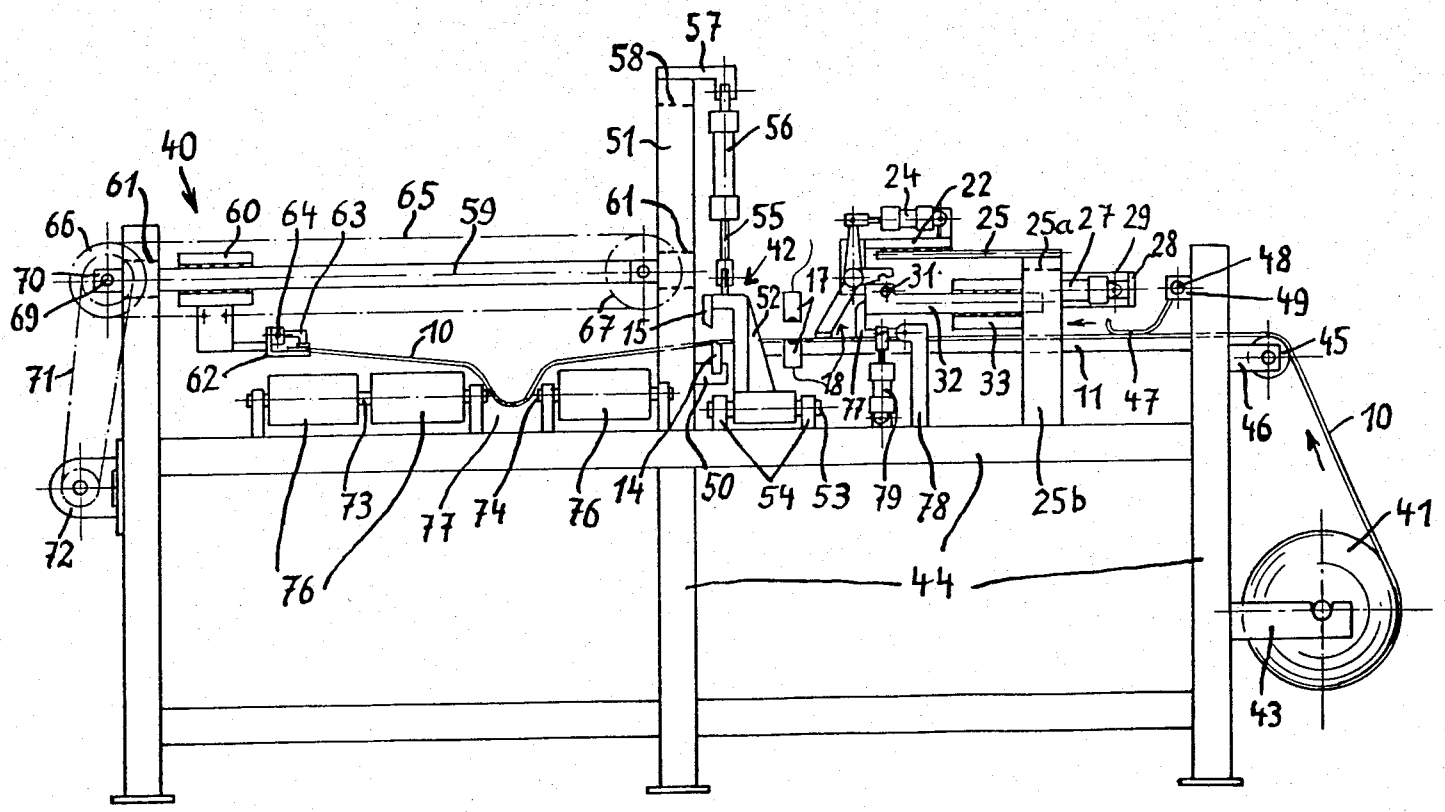
FIG. 7 is a side elevational view of the straightening device according to the invention.

Pulling device 40 for strip 10 has a guide rod 59 arranged parallel to its pulling direction and to the middle axis of the device, with which is associated a sliding guide element 60. Guide rod 59 is mounted between transverse stays 61 of stand 44. Guide element 60 supports an L-strap 62 extending over strip 10, to which is rotatably mounted a shaft 64 which runs parallel to it. Clamps 63 are mounted on shaft 64 at equal spacing from each other. Shaft 64 can for instance be rotated back and forth by an electro-rotary magnet around a certain curved angle, in order to open and close clamps 63 (FIG. 7). Thus, clamps 63, in connection with the bottom horizontal arm 62 of the L-strap, could grasp the free transverse edge of strip 10.

Guide element 60 is connected with an endless drive chain 65, which is guided around a freely rotatable chain wheel 67 and a drive chain wheel 66. The rotating chain wheel 67 is supported by an arm 68, mounted on transverse strut 61 of stand 44. Drive chain wheel 66 is mounted on a shaft 69, which is supported rotatably in two arms 70, which in turn are mounted on transverse strut 61 of stand 44. Shaft 69 is driven by an endless drive chain 71, driven by an electromotor 72, mounted on stand 44. Electromotor 72 can turn in both directions, in order to move guide element 60 to the right or to the left over drive chains 71, 65, as in FIG. 7, i.e., the beginning of the following work step is triggered at the end of each work step. Electromotor 72 can be connected and disconnected over not shown limit switches by guide element 60.

Beneath and to the side of the movement area of clamps 63, two shafts 73, 74 are rotatably mounted on stand 44 and support one or two guide rollers 75. Conveyor belts 76 of a known type of transverse conveyor device pass over these rollers 75, of which the drive is not shown. This transverse conveyor device transports pieces separated by separator 42 away to the side of strip 10. Between shafts 73 and 74 is a certain space, in order to form a clearance 77 between the adjacent conveyor belts 76, and, as shown in FIG. 7, a fold can be formed there in the textile material strip 10, which occurs in the still to be described straightening process.

Figure 6:
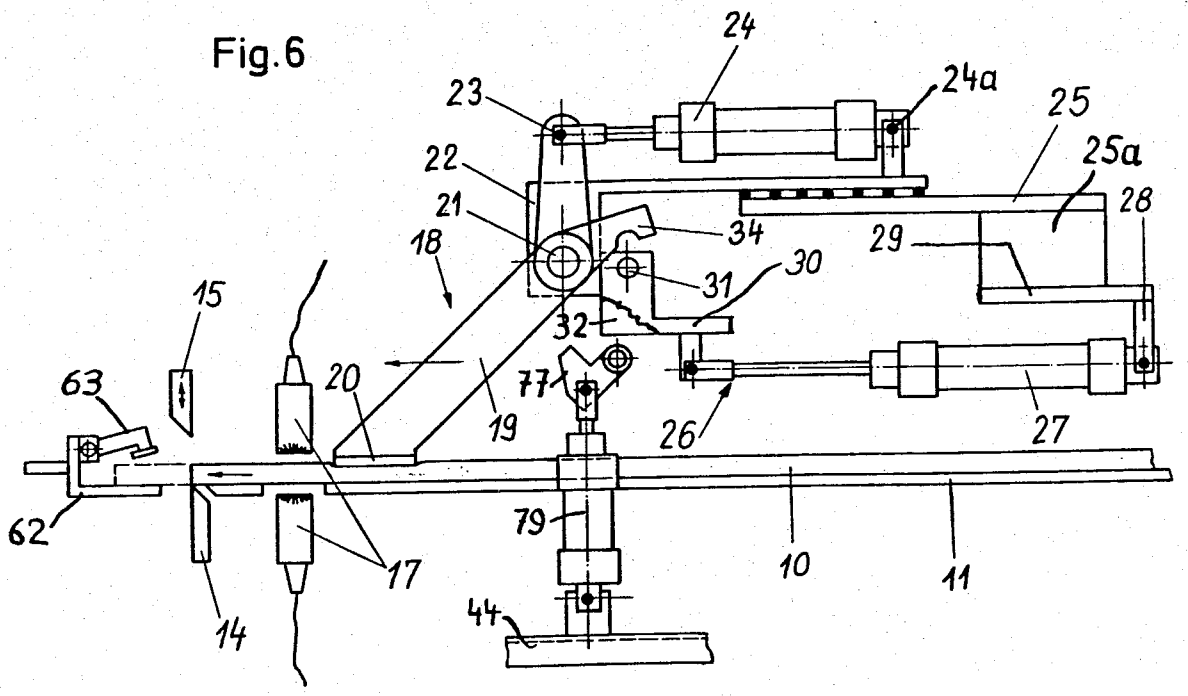

Guide element 60 and clamps 63 of pulling device 40 can be moved back and forth by drive motor 72 between two end positions. For this purpose, drive chain 65 of electromotor 72 can be driven either counterclockwise or clockwise, and, as described already, electromotor 72 is disconnected in either end position by means of not shown limit switches. When clamps 63 are in the right end position, they can be pivoted by the not shown rotary magnet over shaft 64 in a clockwise direction (FIG. 6), in order to grasp the transverse edge of the following section of strip 10, and then can pull it. During this pulling movement, brake plates 47 exert a friction or holding force on strip 10, so that this strip remains stretched over support plate 11.

Figure 8:
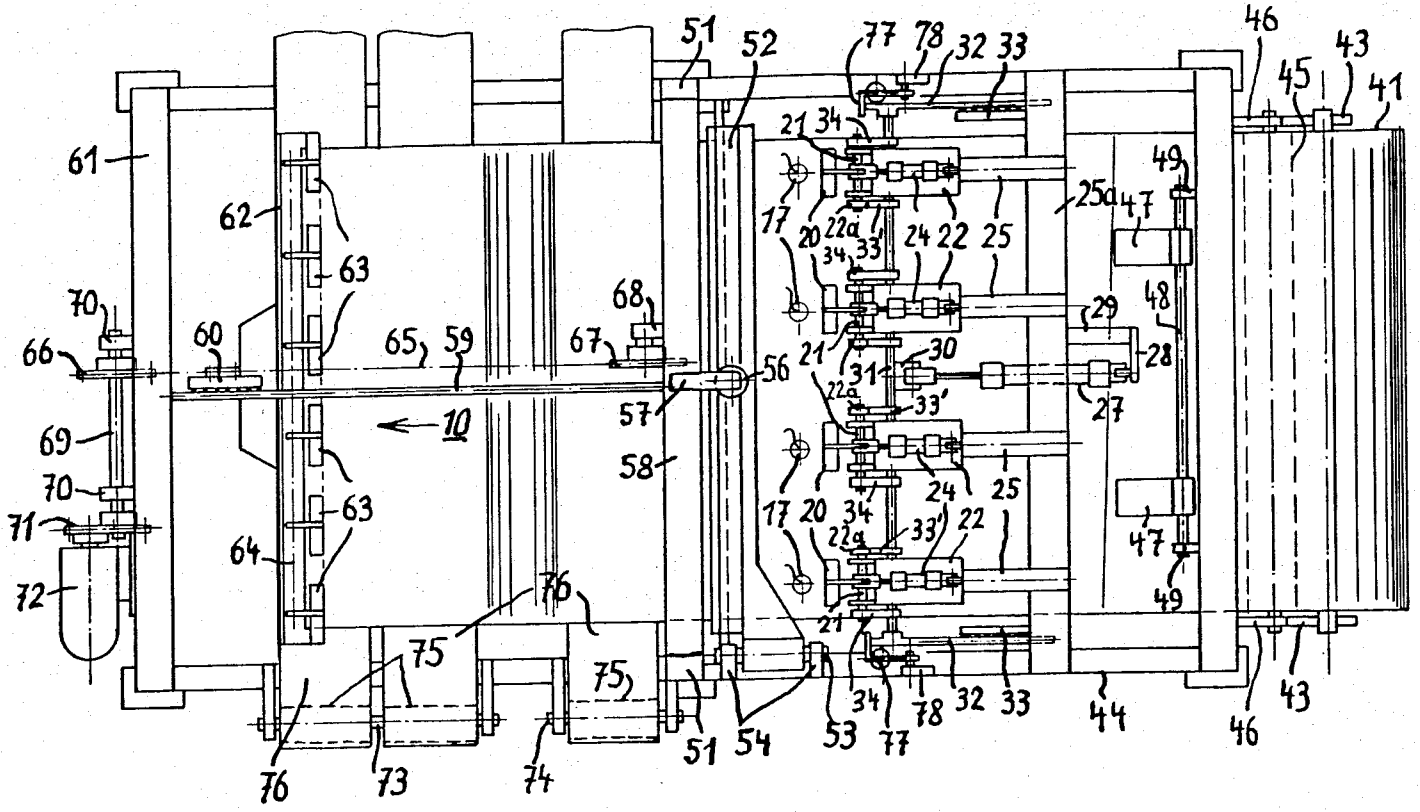
FIG. 8 is a plan view of the straightening device shown in FIG. 7.

The straightening device in the exemplary embodiment has several pairs of scanning elements 17, which are arranged on not shown struts transverse to the length of strip 10 with side spacing from each other along a straight line above and beneath strip 10, and the struts are in turn supported on stand 44. Scanning elements 17 in the present case can consist of electromagnetic scanning heads, which react to the passage of metallic marking thread 16 and trigger a control signal, the purpose of which will be described hereinafter. In FIGS. 1 and 8, scanning elements 17 are indicated diagramatically by circles.

The straightening device also has a plurality of straightening elements 18, each comprising a lifting arm 19 and a free end attached to its footplate 20. Each lifting arm 19 is arranged nonrotatably on a shaft 21, which in turn is mounted rotatably on a carriage 22. These carriages are not shown in FIG. 1.

On each shaft 21 is also found a nonrotatable actuation arm 23. Actuation arms 23 can each be power-connected with the piston rod of a compressed air cylinder 24. Compressed air cylinders 24 are fastened at 24*a* to carriage 22. When the piston rod of a compressed air cylinder 24 is lowered, straightening element 18 is pivoted by actuation arm 23 and shaft 21 counterclockwise, so that footplate 20 is pressed against strip 10 over support plate 11. Carriages 22 are in turn mounted independently from one another in longitudinal direction and parallel to the pulling direction of strip 10, mounted to slide back and forth each on a plate 25. Plates 25 are mounted separately on a transverse strut 25*a* (FIG. 8), which extends over strip 10 and is supported at its ends by two supports 25*b* (FIG. 7), which in turn are mounted on stand 44. With this arrangement of carriages 22, the straightening elements 18 can be carried along by strip 10 into work position (lowered position in FIGS. 3–6), in the direction of the arrow and in raised position in the opposite direction. Transport device 26, for example, has a compressed air cylinder 27 arranged in the middle beneath transverse strut 25*a*, the end of which is connected with a part 29 which is turned downwardly on the bottom of transverse strut 25*a*. The free end of the piston rod of compressed air cylinder 27 is connected with an actuator 30 for a drive rod 31, which extends over strip 10 and is connected at both ends with guides 32, which are supported in roller guides 33 lengthwise to strip 10, movable back and forth. Roller guides 33 are mounted on supports 25*b* (FIG. 7) of stand 44.

Figure 3:
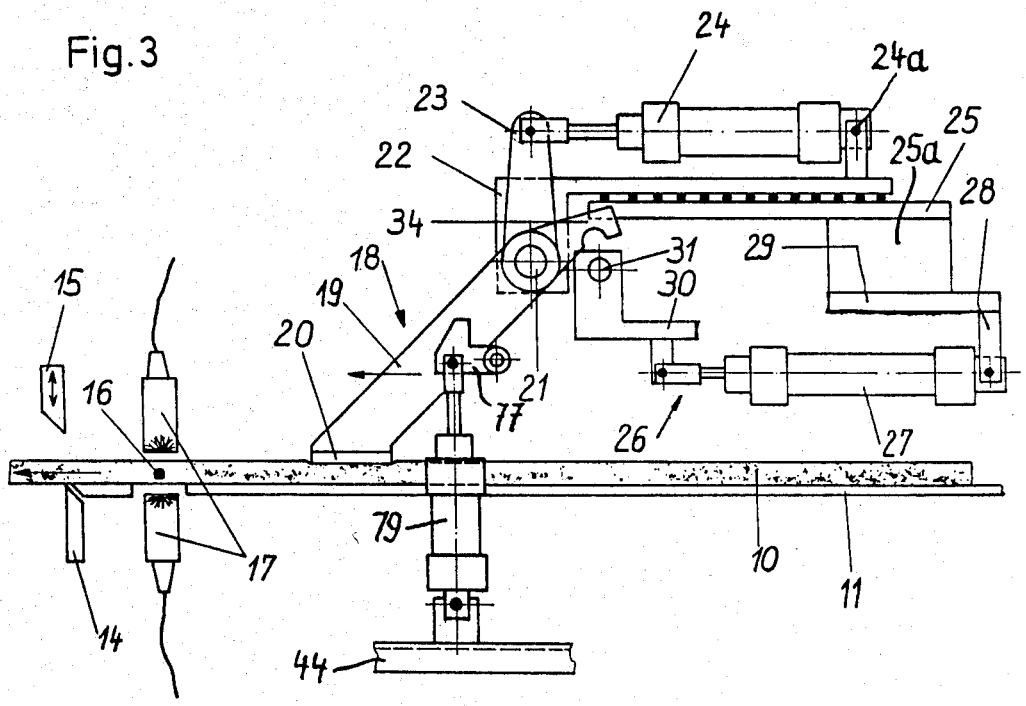
Figure 4:
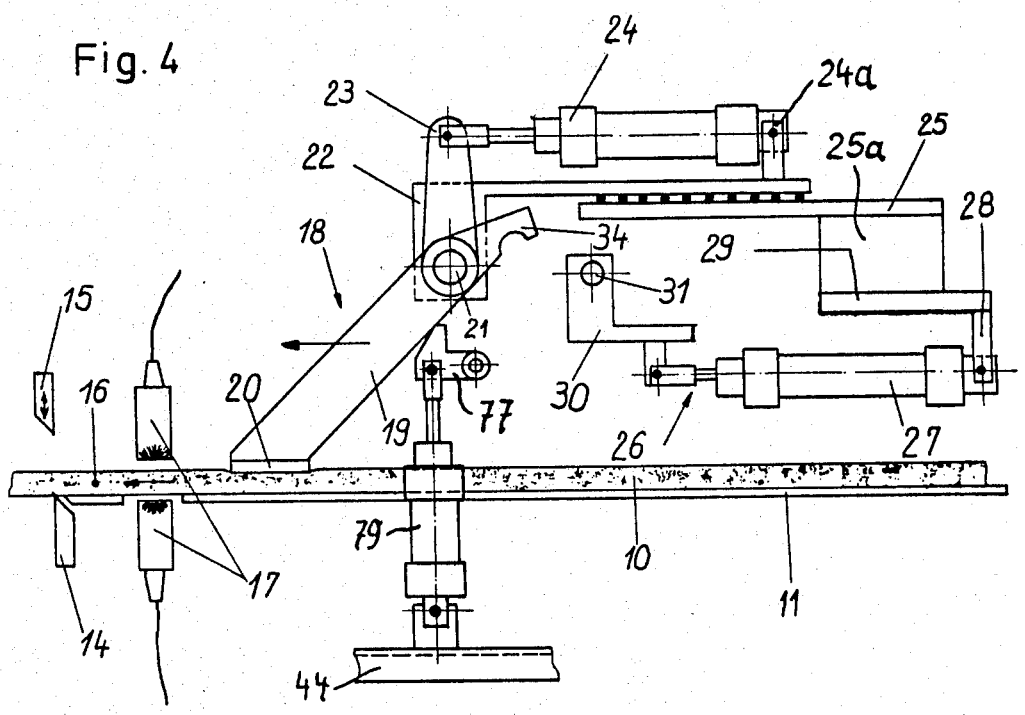
Figure 5:
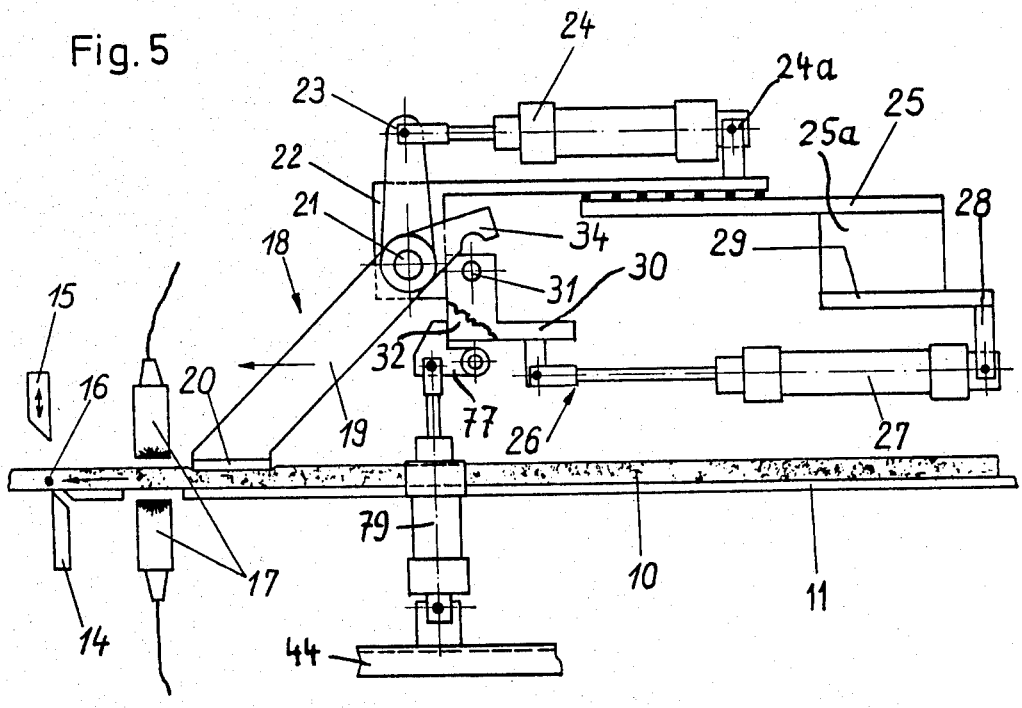

FIGS. 1 and 8 show drive rod 31 supporting a plurality of block-shaped parts 33', which, when the piston rod of compressed air cylinder 27 is lowered, come into position with catch parts 22*a* on shafts 21, in order to move carriages 22 and therewith the straightening elements 18 as in FIGS. 3–5 in the direction of the arrow, for the purpose of straightening strip 10.

Figure 2:
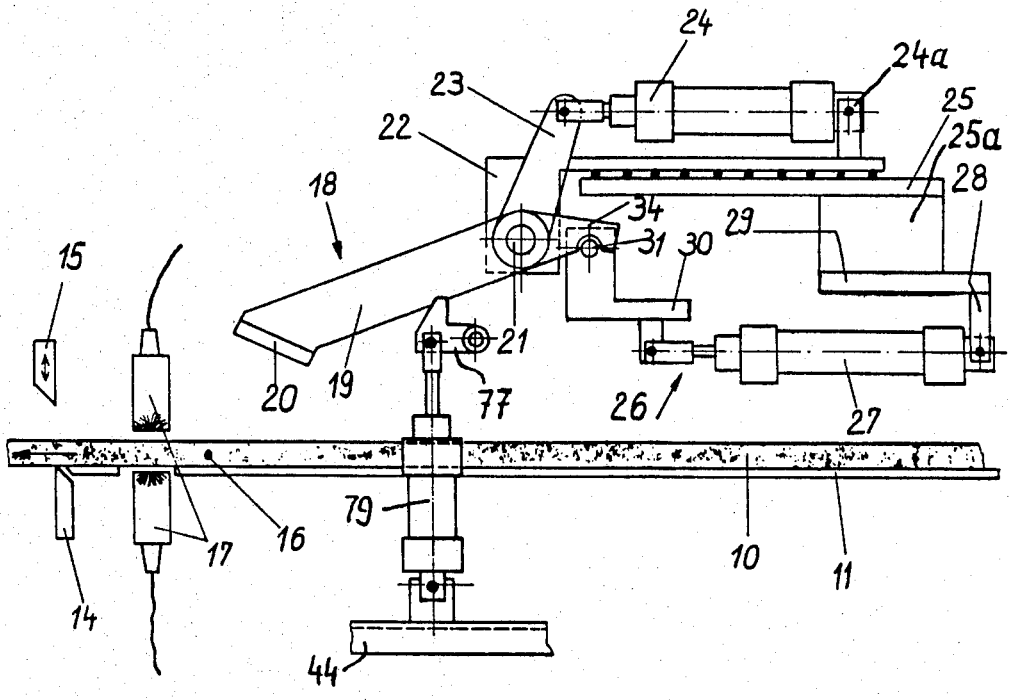
FIGS. 2–6 are different diagrammatic side views of the straightening device, in the starting position and in different work phases, together with a separating device for the strip of textile material, and scanning elements.

Other nonrotatable pawls 34 are mounted on shafts 21 supported on carriages 22, and when straightening element 18 is raised or the piston rod of a compressed air cylinder 24 is drawn back, pawls 34 engage with drive rod 31 (FIG. 2). Thus, carriages 22 can be carried back together with straightening elements 18 by transport device 26 into their starting position shown in FIG. 2 and can be held there.

The straightening device operates as follows:

At the beginning a work cycle, first of all a section of strip 10 is manually drawn from delivery spool 41 over guide roller 45 and over support plate 11, so that the transverse edge of this section of the strip, shown in FIG. 7, lies to the left of separating device 42, so that this transverse edge can be grasped by clamps 63. Electromotor 72 is connected so that it drives the drive chain 65 counterclockwise in FIG. 7, in order to move clamps 63 into their right end position. As soon as they have reached the end position, the electromotor is disconnected by the not shown limit switch. The opened clamps 63 are closed by the not shown rotary magnet over shaft 64, and they grasp the transverse edge of the section of the strip. At this point, top blade 15 is raised and straightening elements 18 return to their starting position shown in FIG. 2. Then electromotor 72 is reconnected, in order to drive drive chain 65 of FIG. 7 clockwise, in order to move guide piece 60 and therewith clamps 63 to the left in FIG. 7, and one section of strip 10 is pulled so that it lies over the transverse conveyor device with conveyor belts 76.

It is premised that strip 10 has a metallic marking thread 16 on or in the area of a separating point. If now, as in FIG. 1, strip 10 is distorted or misaligned in the area of the separation point, the correspondingly skewed marking thread 16, with the pulling movement of strip 10, first appears through the pair of scanning elements 17 lying farthest to the right in FIG. 1, which pick up on this marking thread as being skewed and trigger a control signal, which, over a not shown circuit, actuates a magnetic valve for compressed air cylinder 24 of the straightening element 18, which is aligned with scanning element 17 lying furthest to the right in FIG. 1. Compressed air cylinder 24 pivots straightening element 18 counterclockwise, so that its footplate 20 is pressed against strip 10. Strip 10, during the process of the aforementioned pulling movement, moving further in the direction of the arrow, takes along straightening element 18, which engages with it. This work phase is shown in FIG. 3. It is now to be noted that when a straightening element 18 is in this work position, pawl 34 is released by drive rod 31, so that carriage 22 can be moved freely on its stationary plate 25 in pulling direction.

As the pulling continues, when strip 10 continues in the direction of the arrow, marking thread 16 runs through the second pair of scanning elements 17, which trigger a second control signal, which operates in the aforementioned manner, so that straightening element 18 aligned to this scanning element 17 is pressed with its footplate 20 against strip 10. Carriage 22 of this straightening element 18 is now likewise carried along by strip 10 in pulling direction.

The described process is repeated with the passage of marking thread 16 through the remaining pairs of scanning elements 17, until finally all of the straightening elements 18 are found with their footplates 20 in engagement with strip 10 and are carried along by the strip in pulling direction. When this state is reached, i.e., when all of the straightening elements 18 have been lowered onto strip 10 which is to be straightened and are being carried along, then electromotor 72 is disconnected, in order to terminate the pulling of strip 10. This disconnection of motor 72 occurs over the aforementioned limit switch, and thereby guarantees that drive motor 72 is not disconnected until all straightening elements 18, as explained above, are in engagement with strip 10.

At the same time, transport device 26 starts to operate (on the basis of a known sequence control). The moving piston rod of compressed air cylinder 27 thereby moves drive rod 31 in the pulling direction of strip 10, and drive rod 31 reaches carriage 22 of the first straightening element 18 which is released from the pawl and is lowered, and pushes this before it. This work phase is shown in FIG. 3. With the engagement of this straightening element 18 with strip 10, also the part of strip 10 which is found beneath element 18 is carried along in the pushing (arrow) direction.

With further forward movement of drive rod 31, little by little carriages 22 of all lowered straightening elements 18 are reached and carried along in the pushing (arrow) direction, until all straightening elements 18 are aligned transverse to the length of strip 10 or lie in a straight line running parallel to separating device 42 (FIG. 8). When this state is reached, also weft stitches 13 run in the area of marking thread 16, i.e., in the area of the aforementioned separating point, without any difficulty, at a right angle to the outside edges of strip 10 or to the pushing direction and therefore parallel to separating device 42. The movement of the piston rod of compressed air cylinder 27 and therewith the thrust of strip 10 in pushing direction ceases in the moment when marking thread 16 is found between top blade 15 and bottom blade 14 of separating device 42 (FIG. 5). Two catches 77 are provided for this purpose, against which engage guide pieces 32 of drive rod 31, in order to block their further movement in pushing direction. Catches 77 can be rotated on arms 78, which are mounted on stand 44. Catches 77 in the form of toggle levers can be pivoted out of their work position shown in FIG. 5 into their non-work position shown in FIG. 6 and vice versa each by a compressed air cylinder 79 articulated with the piston rod on a catch 77, and mounted with the cylinder on stand 44.

When guide pieces 32 of drive rod 31 engage on these catches 77, any further work lifting force of compressed air cylinder 27 is thus eliminated and strip 10 is therefore held in pushing direction, and marking thread 16 is found between top blade 15 and bottom blade 14, and separating device 42 can now operate, in order to carry out the straight separating cut. For this purpose, piston rod 55 of compressed air cylinder 56 goes out, and the blade carrier 52 pivots around its axis 53 and is moved downward, in order to move top blade 15 vertically against stationary bottom blade 14. After the separating cut and lifting of blade support 52 by compressed air cylinder 56, catches 77 are rotated by their compressed air cylinder 79 into their non-working position shown in FIG. 6, so that guide pieces 32 of drive rod 31 are again free and the piston rod of compressed air cylinder 27 can still move a certain distance in its end position. This remaining force of compressed air cylinder 27 is thus required both during and following the lowering of straightening element 18, in order to still move strip 10 a certain distance in pushing direction out over separating device 42, and this piece is indicated in broken lines in FIG. 6.

Then, with the subsequent work cycle, clamps 63 of pulling element 40 can engage this piece of strip 10. First, i.e., following termination of the remaining force of cylinder 27, straightening elements 18 are pivoted by their compressed air cylinder 24 in clockwise direction, and pawls 34 mesh on drive rod 31 (FIG. 2). After the subsequent meshing of pawls 34 on drive rod 31, the piston rod of compressed air cylinder 27 is driven forward or pulled back, which carries drive rod 31 along with it in the same direction and thereby guides all carriages 22 back into the starting positions shown in FIG. 2.

At this point it is to be noted that with the above thrust movements of strip 10 by transport device 26 over lowered straightening elements 18, a fold can be formed in space 77 between the adjacent conveyor belts 76. The textile strip section separated by separating device 42, after it has been freed by opening of clamps 63, is transported away to the side by the transverse conveyor device. Drive motor 72 is now reconnected, in order to drive drive chain 65 counterclockwise as in FIG. 7, so that guide piece 60 and clamps 63, as in FIG. 7, can be moved into their right end position. Opened clamps 63 in this end position grasp the part of strip 10 which is projecting over separating device 42 and it begins a new work cycle.

Insofar as the textile strip is also distorted or misaligned at the following separating points, the described straightening process is repeated, so that strip 10 is cut through only in straight cuts by separating device 42, without difficulty.

Instead of strips of textile materials, the device of the invention could also be applied to other strip-form materials, e.g., printed foil strips, in order to attain the same, e.g., straight-edge, separation.

What we claim is:

1. A device for straightening and cutting a distorted strip article having a marking thereon, comprising:

means for feeding the strip article from a source of supply to a predetermined position for straightening;

means for straightening the article when in said predetermined position, said straightening means comprising a plurality of independently movable straightening elements disposed substantially transversely to the longitudinal direction of the strip article, a transport device for independently adjusting said straightening elements in the longitudinal direction of the strip article, means for pressing said straightening elements independently against the strip article as it is fed toward said predetermined position so that said straightening elements pressed against the strip article move with it toward said predetermined position, and sensor means for controlling said pressing means in response to control signals produced by the marking on the article, said transport device serving to align said straightening elements after they are pressed against the strip article substantially transversely to the longitudinal direction thereof to straighten the strip article when it is in said predetermined position;

means for cutting the article after it has been straightened by said straightening means;

said pressing means serving to move said straightening elements out of engagement with the strip article after it has been cut by said cutting means; and carriages supporting said straightening elements for movement in a substantially vertical plane, and means for movably supporting said carriages for movement between a first position wherein they are coupled with said transport device to be moved therewith to a starting position after the cutting of the strip article, and a second position wherein they are released from said transport device during the engagement of said straightening elements with the strip article.

2. Device as in claim 1, characterized in that said sensor means device has a plurality of sensor elements, arranged substantially transverse to the length of the strip article at such a spacing from each other that said sensor elements are substantially aligned with the straightening elements in the discharge direction of the strip article.

3. Device as in claim 1, characterized in that a plate extends substantially transversely over the strip article and movably supports said carriages and said transport device.

4. Device as in claim 1, characterized in that the straightening elements are pivotally movable, and pawls are fixedly connected to the straightening elements for engagement with the transport device.

5. Device as in claim 1, characterized in that said transport device is disposed substantially transversely to the length of the strip article in the area of the marking thereon.

6. Device as in claim 1, characterized in that said transport device has a drive member extending substantially transversely over the strip article and adapted to be drivingly connected to said carriages to effect the transverse alignment of said straightening elements pressed against the strip article.

* * * * *